US008950581B2

(12) United States Patent
Busch

(10) Patent No.: US 8,950,581 B2
(45) Date of Patent: Feb. 10, 2015

(54) STACKABLE CONTAINER

(75) Inventor: Craig Busch, Barrie (CA)

(73) Assignee: Busch Systems International Inc., Barrie, Ontario ( * ) Notice: Subject to any disclaimer, the term of this patent is extended or adjusted under 35 U.S.C. 154(b) by 102 days.

(21) Appl. No.: 12/956,788

(22) Filed: Nov. 30, 2010

(65) Prior Publication Data

US 2012/0132558 A1 May 31, 2012

(51) Int. Cl.
*B65D 21/06* (2006.01)

(52) U.S. Cl.
CPC ..... *B65D 21/062* (2013.01)
USPC ..... 206/506; 206/505; 220/23.86; 220/4.27; 220/4.26

(58) Field of Classification Search
CPC .. B65D 21/0233; B65D 21/048; B65D 21/04; B65D 21/062; B65D 21/06; B65D 25/2852; B65D 25/2855; B65D 25/2835
USPC ..... 206/503, 506, 505, 510, 509; 220/760, 220/756, 659, 657, 656, 759, 23.86, 23.83, 220/4.27, 4.26
See application file for complete search history.

(56) References Cited

U.S. PATENT DOCUMENTS

| | | | | |
|---|---|---|---|---|
| 4,247,004 | A * | 1/1981 | Bird | 206/506 |
| 4,346,805 | A * | 8/1982 | Upperton | 206/506 |
| 4,391,369 | A * | 7/1983 | Stahl et al. | 206/506 |
| 4,567,985 | A * | 2/1986 | Beljaars | 206/506 |
| 4,770,300 | A * | 9/1988 | Klein | 206/506 |
| 5,335,789 | A * | 8/1994 | Taravella et al. | 206/518 |
| 5,511,279 | A * | 4/1996 | Ippolito | 15/257.06 |
| 5,593,037 | A * | 1/1997 | Ohayon | 206/509 |
| 6,059,114 | A * | 5/2000 | Loftus | 206/506 |
| 7,823,728 | B2 * | 11/2010 | Baltz | 206/506 |
| 2003/0197014 | A1 * | 10/2003 | Muchin et al. | 220/318 |
| 2006/0096883 | A1 * | 5/2006 | Raghunathan et al. | 206/506 |
| 2007/0246393 | A1 * | 10/2007 | Hassell et al. | 206/506 |
| 2009/0294451 | A1 * | 12/2009 | Martheenal | 220/495.11 |

FOREIGN PATENT DOCUMENTS

EP 678454 A1 * 10/1995 ..... B65D 21/04

OTHER PUBLICATIONS

"The MURFE Stackable Recycler—Specialty Containers," http://www.recy-cal.com/muapre.html, printed Feb. 17, 2011, 1 page.
"Norseman Environmental::Recycling Bin NPL 215," http://norsemanplastics.com/products/norseman_recyclingbin_npl_215.html, printed Feb. 17, 2011, 1 page.

* cited by examiner

*Primary Examiner* — Robert J Hicks
(74) *Attorney, Agent, or Firm* — Fish & Richardson P.C.

(57) ABSTRACT

This invention relates to a stackable container adapted to be stacked with a second substantially identical container in two positions. The container comprises a container body; and an arm movably connected to the container body. The container body comprising a base and walls extending upwardly from the base. The walls define an interior space and an opening. The arm is movable between a first position and a second position. In the first position, the arm provides a support for the second substantially identical container wherein, when stacked, the second identical container is supported above the stackable container with at least part of the interior accessible. In the second position, the arm is positioned to allow the second identical container to nest within the stackable container with the interior space inaccessible.

25 Claims, 12 Drawing Sheets

STACKABLE CONTAINER

FIELD

This application relates to stackable containers and in particular to stackable containers for stacking on top of each other.

BACKGROUND

Society is becoming increasingly aware of a need to take care of the environment. There are a number of ways of reducing the impact of humans on the environment. An often spoken adage is the need to "Reduce-Reuse-Recycle". The third "R", recycling, poses a number of challenges.

One of the challenges is that different materials are subject to different recycling processes at different recycling plants. This means that the materials need to be sorted. If the materials are sorted by the consumers, the need for a sorting plant may be reduced or eliminated.

Many communities have systems in place to facilitate sorting by consumers. For example, many communities provide a "Blue Box" for plastics and metals, a "Black Box" for paper and cardboard, and a "Green Box" for compostable items. These programs may be for both residential areas and for businesses. However, these various boxes take up a significant amount of space. This is particularly the case in apartments, condominiums and office buildings where there is limited space for the various containers that would allow consumers to sort items and maximize what can be recycled.

SUMMARY

An aspect of embodiments disclosed herein relates to a stackable container adapted to be stacked as an upper container or as a lower container with a second substantially identical container in two positions, the stackable container comprising: a container body; and an arm movably connected to the container body; the container body comprising a base and walls extending upwardly from the base; the walls defining an interior space and an opening; wherein the arm is movable between (i) a first position in which the arm of the stackable container, when the stackable container is the lower container, provides a support for the upper container wherein, when stacked, the upper container is supported above the stackable container with at least part of an interior of the stackable container accessible; and (ii) a second position in which, when the stackable container is the lower container, the arm is positioned to allow the upper container to nest within the stackable container with the interior space of the stackable container inaccessible.

In some embodiments, the arm is rotatably connected to the stackable container.

In some embodiments, the arm is a handle.

In some embodiments, the arm is movable to a third position for carrying the stackable container.

In some embodiments, the stackable container and the arm are symmetrical and the arm is rotatably connected to the stackable container at two symmetrical points.

In some embodiments, in the first position, the arm does not cross the opening.

In some embodiments, the arm is parallel to the base in both the first and second positions.

In some embodiments, a first wall of the walls defines a first contour shaped to rest on the arm of the lower container when the stackable container is the upper container and the stackable container is stacked on the lower container in the first position.

In some embodiments, the first contour comprises a lower portion of the first wall being inset from the upper portion of the first wall to define a ledge for resting on the arm of the lower container when the stackable container is the upper container.

In some embodiments, a second wall of the walls defines a second contour shaped to rest on an upper end of a second wall of the lower container when the stackable container is the upper container and the stackable container is stacked on the lower container in the first position.

In some embodiments, the upper end of the second wall of the stackable container defines a lip of the stackable container and the second contour of the stackable container rests on the lip of the lower container in the first position.

In some embodiments, the second contour comprises a lower portion of the second wall being inset from an upper portion of the second wall to define a ledge for resting on the lower container.

In some embodiments, the stackable container is offset forwardly from the upper container in the first position when the stackable container is the lower container.

In some embodiments, the walls define a lip and the lip of the upper container rests on the lip of the lower container when stacked in the second position when the stackable container is the lower container.

In some embodiments, the walls define an opening which is open on at least one side when the upper container is stacked on the lower container in the first position.

In some embodiments, the opening is closed when the upper container is stacked on the lower container in the second position.

In some embodiments, the arm comprises at least one c-clamp and is rotatably connected to the stackable container by the at least one c-clamp, wherein the c-clamp is downwardly open in the second position.

In some embodiments, at least three of the walls are substantially planer.

Another aspect of embodiments disclosed herein relates to a stackable container adapted to be stacked as an upper container or as a lower container with a second substantially identical container in two positions, the stackable container comprising: a container body; and a member movably connectable to the container body; the container body comprising a base and walls extending upwardly from the base; the walls defining an interior space and an opening; wherein movement of the member alone changes the stackable container from (i) a first position in which the member of the stackable container, when the stackable container is the lower container, provides a support for the upper container wherein, when stacked, the upper container is supported above the stackable container with at least part of an interior of the stackable container accessible; and (ii) a second position in which, when the stackable container is the lower container, the member is positioned to allow the upper container to nest within the stackable container with the interior space of the stackable container inaccessible.

In some embodiments, the member is rotatably connected to the stackable container.

Other aspects and features of the present invention will become apparent, to those ordinarily skilled in the art, upon review of the following description of the specific embodiments of the invention.

BRIEF DESCRIPTION OF THE DRAWINGS

The invention will now be described in greater detail with reference to the accompanying drawings, in which.

DETAILED DESCRIPTION

Figure 1:
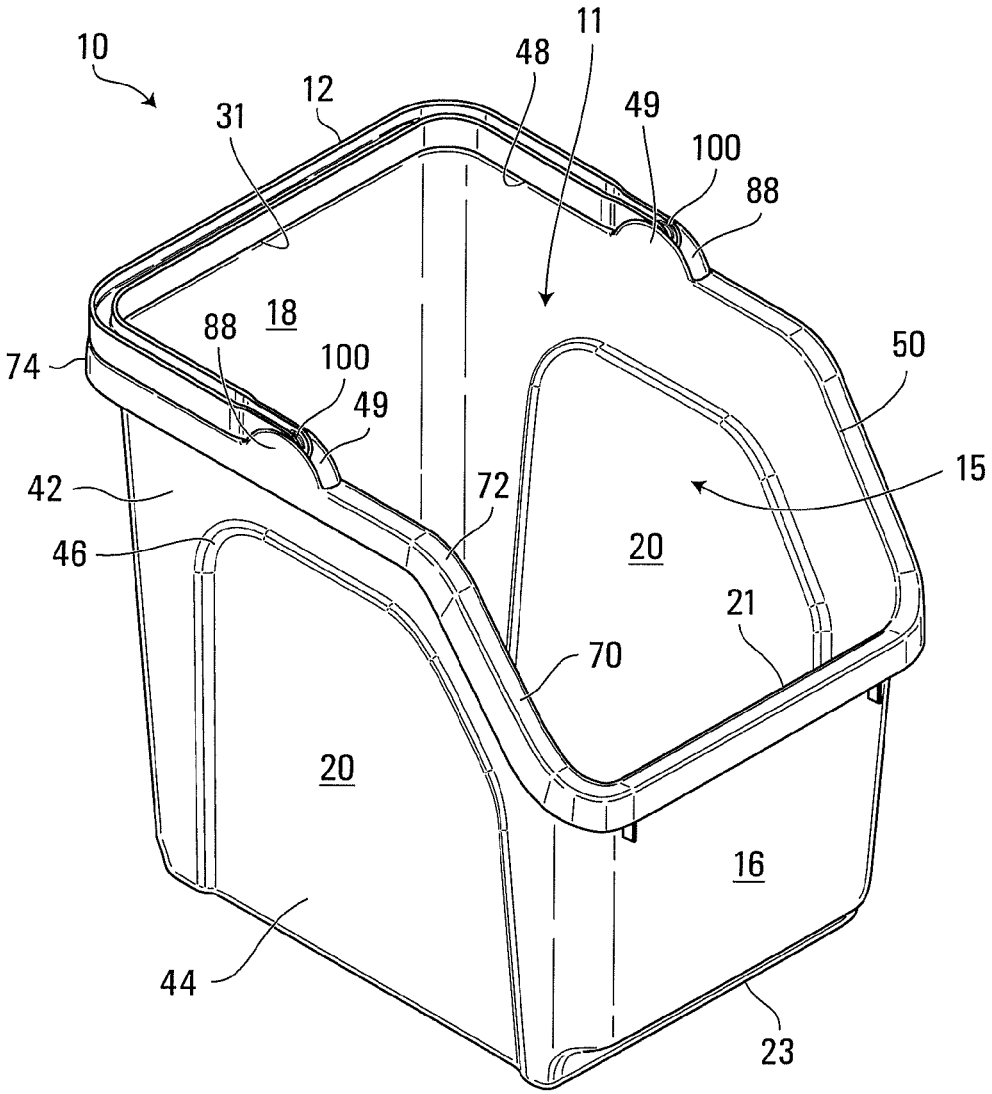
FIG. 1 is a perspective view of a stackable container according to an embodiment of the invention with a handle in a rearward position.

FIGS. 1 to 8 show a container 10 according to an embodiment of the invention with a handle 12 in three different positions. In FIGS. 1 to 4, the handle 12 is in a rearward position, in FIGS. 5 and 6 the handle 12 is in an upright position and in FIGS. 7 and 8 the handle 12 is in a forward position.

The container 10 has a base 14, a front wall 16, a rear wall 18, and side walls 20 which together for a body of the container 10 having an interior space 11. The container 10 has an opening 15 at the top.

The front wall 16 of this embodiment extends upward at a slightly forward angle with an upper end 21 and a lower end 23. The upper end 21 and the lower end 23 of the front wall 16 of this embodiment are substantially horizontal. The front wall 16 has a generally planer surface but has a contour 22 adjacent the lower end 23 (see FIGS. 2, 5 and 7). In other embodiments, the front wall 16 may have other shapes and may have, for example, a rounded or semi-circular cross-section. The front wall 16 may also be completely upright or inwardly angled.

The contour 22 divides the front wall 16 into a top section 24 and a bottom section 26. The contour 22 curves inward across the width of the front wall 16 such that the bottom section 26 of the front wall 16 is inset from the top section 24 of the front wall 16. The contour 22 thus forms a support ledge 28 across the front wall 16.

Although a specific type of outward discontinuity, namely the contour 22, is described, it will be understood that the discontinuity may be formed in other ways. For example, the front wall 16 may be planer with one or more outward projections that may be permanent or may be slid, fitted or rotated outward when needed. The contour 22 may also be eliminated so that the front wall 16 has no contour, projection or discontinuity.

The rear wall 18 of this embodiment extends upward at a slightly rearward angle with an upper end 31 and a lower end 33. The upper end 31 and the lower end 33 of the rear wall 18 of this embodiment are substantially horizontal. The rear wall 18 has a generally planer surface but has a contour 32 adjacent the lower end 33. In other embodiments, the rear wall 18 may have other shapes and may have, for example, rounded or semi-circular cross-section. The rear wall 18 may also be completely upright or inwardly angled.

The contour 32 divides the rear wall 18 into a top section 34 and a bottom section 36. The contour 32 curves inward across the width of the rear wall 18 such that the bottom section 36 of the rear wall 18 is inset from the top section 34 of the rear wall 18. The contour 32 thus forms a support ledge 38 across the rear wall 18.

Although a specific type of outward discontinuity, namely the contour 32, is described, it will be understood that the discontinuity may be formed in other ways. For example, the rear wall 18 may be planer with one or more outward projections that may be permanent or may be slid, fitted or rotated outward when needed. The contour 32 may also be eliminated so that the rear wall 18 has no contour, projection or discontinuity.

In this embodiment the front wall 16 is shorter in height than the rear wall 18. In other embodiments, the relative size and shape of the front wall 16 and the rear wall 18 may be different. For example, the front and rear walls 16 and 18 may be of equal heights and the front wall 16 and/or the rear wall 18 may have an opening through it. In this embodiment, the support ledge 38 of the rear wall 18 is closer to the lower end 33 of the rear wall 18 than the support ledge 32 of the front wall 16 is to the lower end 23 of the front wall 16. The ledge 38 is therefore closer to the base 14 than the ledge 28. In other embodiments, the relative positions of the ledges may differ.

The container 10 also has two side walls 20. The side walls 20 have an outer section 42 and an inner section 44. The outer section 42 has an inverted "U" shape and extends along the front, across the top and down the back of the side walls 20. The inner section 44 is surrounded on the front, back and top by the outer section 42. In this embodiment, the inner section 44 is inset slightly from the outer section 42. The inner section 44 and the outer section 42 are joined by a curved section 46. Both the inner section 44 and the outer section 42 are generally planer and parallel to each other. In some embodiments, the inset adds strength and rigidity to the side walls 20.

The planar surfaces of the walls 16, 18 and 20 can provide multiple locations, up to four locations in this embodiment, for the presentation of information. For example, the identification of a municipality that supplies the container can be stamped on one or more of these relatively large planer surfaces.

In this embodiment, the side walls 20 have a rear section top 48, a front section top 50 and a lower end 51. The rear section top 48 is substantially horizontal and extends along more than half the width of the side walls 20 from the rear wall 18 forward. However, at approximately midway along the top of side wall 20, extending upward from the rear section top 48, is an extension 49 (see FIGS. 1, 6 and 8). In this embodiment, the extension 49 has a substantially semicircular cross-section. In other embodiments, the extension 49 may have other shapes or may be eliminated.

The front section top 50 angles downward from the rear section top 48 towards the front wall 16. In this embodiment, the angle is at about a 45° angle with a gradual decrease in angle adjacent the front wall 16. In other embodiments, the curvature may be at a different angle, at a different location along the side walls 20, or eliminated. In this embodiment, the side walls 20 do not have openings. In other embodiments, the side walls 20 may have one or more openings.

Figure 4:
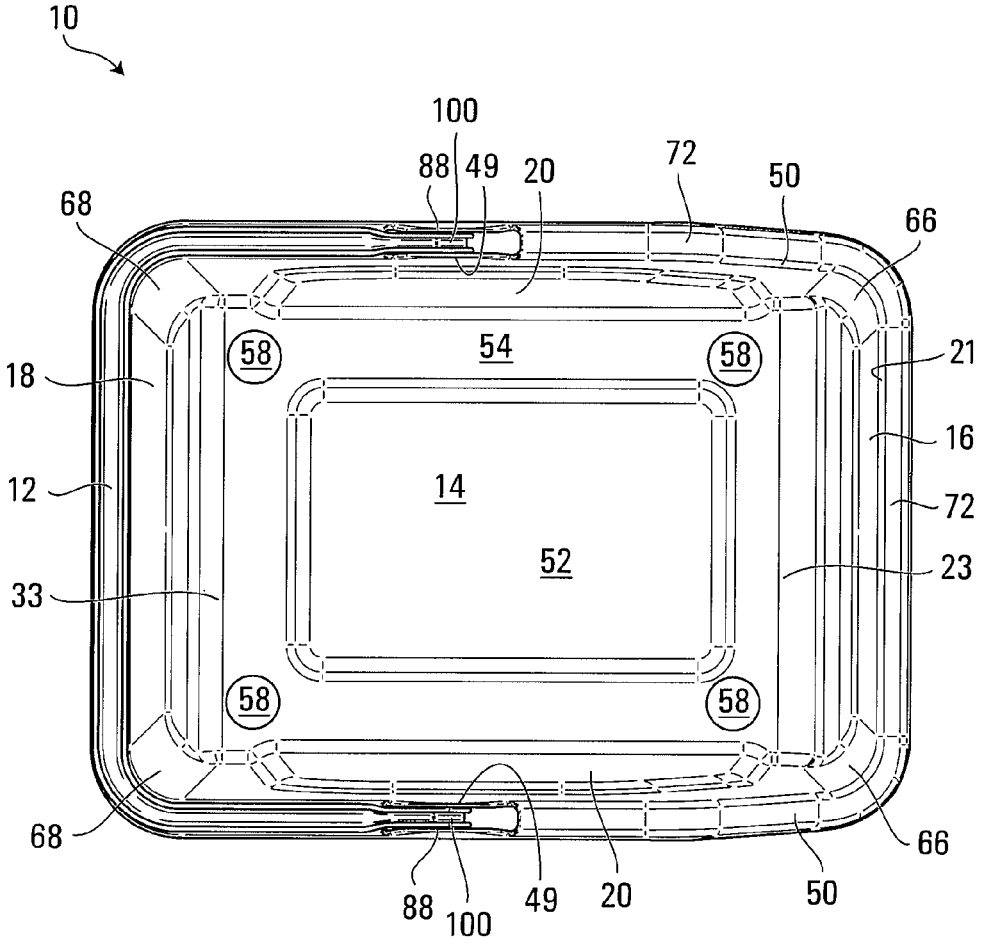
FIG. 4 is a top view of the stackable container of FIG. 1.

The base 14 can best be seen in FIG. 4. The base 14 of this embodiment is substantially rectangular with an inner section 52 and an outer section 54. The outer section 54 is lower than the inner section 52. The outer section 54 is joined to the inner section 52 by a curved section 56. In this embodiment, the outer section 54 has feet 58 at each of four corners. The feet 58 of this embodiment are rounded and downwardly protruding. The feet 58 may be eliminated and the base 14 may be planar.

In this embodiment, the front wall 16 connects to the base 14 along the lower end 23 of the front wall 16. The rear wall 18 connects to the base 14 along the lower end 33 of the rear wall 18. The side walls 20 connect to the base 14 along the lower ends 51 of the side walls 20. The front wall 16 connects to the side walls 20 along front corners 66. The rear wall 18 connects to the side walls 20 along rear corners 68. The lower ends 23, 33 and 51 and the corners 66 and 68 of this embodiment are outwardly rounded. The container 10 may also have square corners and/or ends or some or all of the corners may be eliminated if, for example, the container 10 is cylindrical.

The container 10, of the present embodiment, includes a lip 70 which extents around the entire top edge of the container 10, which includes the upper edge 21 of the front wall 16, the upper edge 31 of the rear wall 18, and the rear section tops 48 and the front section tops 50 of the side walls 20.

The lip 70 includes a ledge 72 and a skirt 74. The ledge 72 has an inside edge 78 and an outside edge 80 (see FIGS. 3, 6 and 8). The ledge 72 connects to the upper ends 21, 31 of the front and rear walls 16, 18 and the front and rear section tops 48, 50 of the side walls 20 of the container 10 along the inside edge 78. The ledge 72 connects to the skirt along the outside edge 80. The ledge 72 extends outward from the container 10 and has a width approximately equal to the width of the handle 12 as will be discussed further below. The ledge 72 is substantially perpendicular to the walls 16, 18 and 20. The skirt 74 extends downward from outside edge 80 of the ledge 72 of the lip 70. The skirt 74 is substantially parallel to the front wall 16, the rear wall 18 and the side walls 20 of the container 10.

In the present embodiment, there is a channel defined between the skirt 74 and the front wall 16, the rear wall 18 and the side walls 20 of the container 10. A number of reinforcing ribs may extend between the shirt 74, the lip 70 and the front wall 16, the rear wall 18 and the side walls 20 to strengthen the lip 70 to support a vertical load. For example, in the present embodiment there are two ribs 82 at the rear wall 18, one rib (not shown) at each of the side walls 20 and two ribs 84 at the front wall 16.

The two ribs 84 are spaced apart symmetrically on the front wall 16. In the present embodiment, the two ribs 84 extend down the front wall 16 a distance below the skirt 74; the ribs 82 and the ribs at the side walls 20 do not. The ribs 84 each have a bottom face 86. In this embodiment, the bottom face 86 is horizontal and forms a support surface as will be described in further detail below. In other embodiments, there may be more of fewer ribs, at the same or other locations, extending downward below the skirt 74 or not. The lip 70 and the skirt 74 may also be omitted or extend less than around the entire top of the container 10.

In this embodiment, along the outside edge 80 of the lip 70 on the side walls 20 are extensions 88. The extensions 88 of this embodiment are laterally aligned with the extensions 49 of the side walls 20. In this embodiment, extending between each extension 49 and the corresponding extension 88 is a circular post 90 (see FIG. 9). The circular posts 90 are located above the plane of the lip 70. There is no lip 70 between the pairs of extensions 49 and 88.

Figure 2:
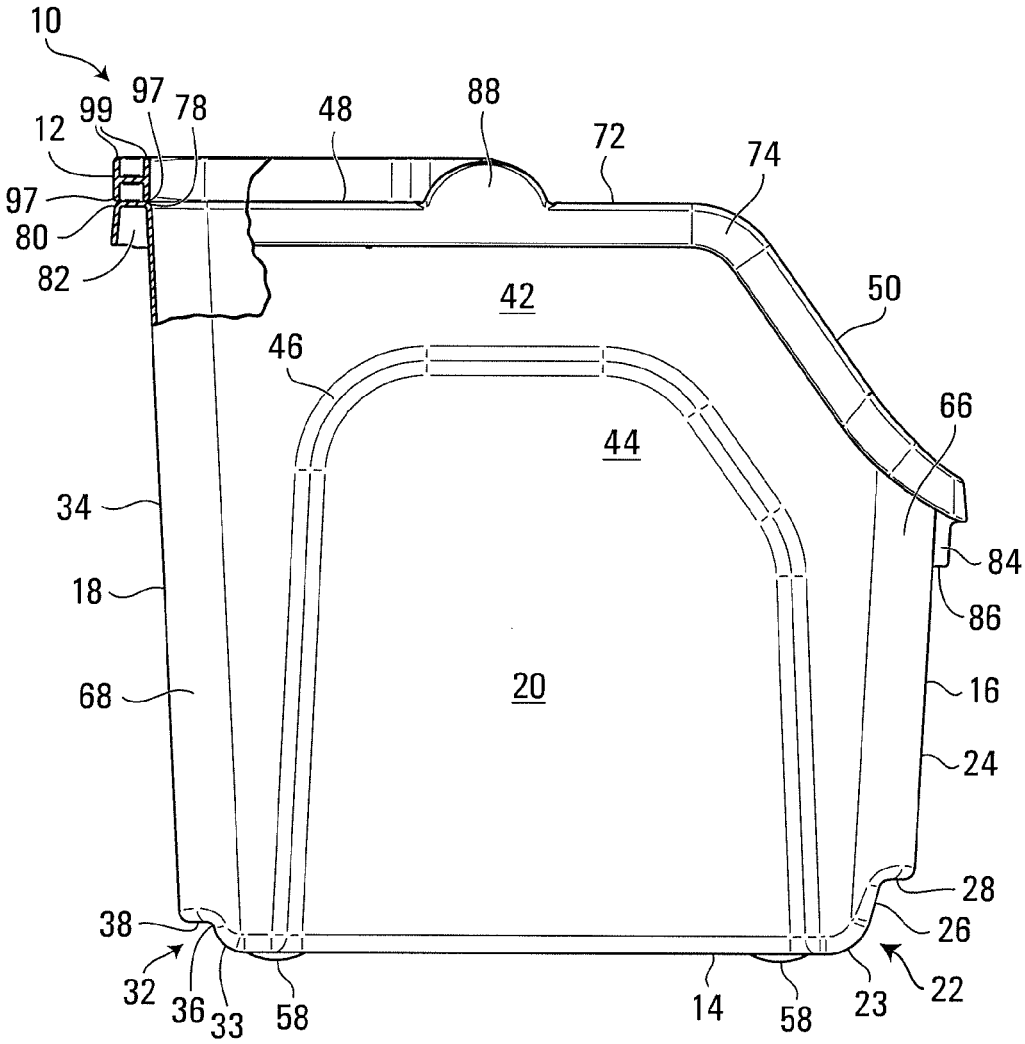
FIG. 2 is a side view of the stackable container of FIG. 1 with a cross-section of the rear top.
Figure 3:
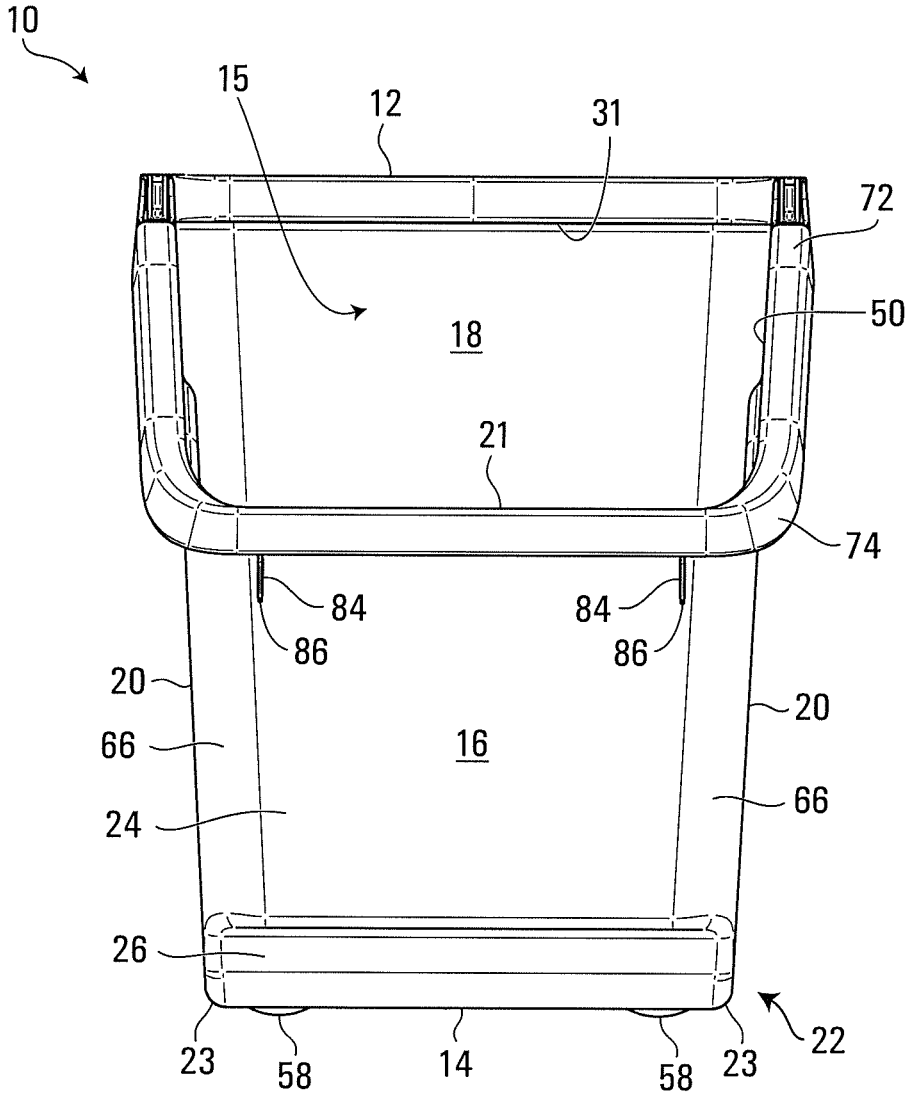
FIG. 3 is a front view of the stackable container of FIG. 1.
Figure 9:
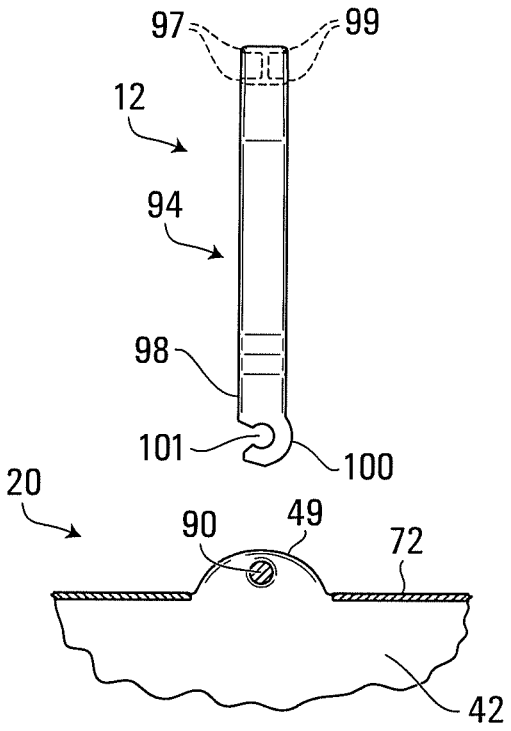
FIG. 9 is an exploded partial section view of a portion of a handle and extension of the stackable container of FIG. 1.

The handle 12 of the container 10 has a generally inverted U-shape with an I-beam cross-section with rear contact edge 97 and forward contact edges 98 (see FIGS. 2 and 9). The channels of the I-beam shape are open in the forward and rear directions when the handle 12 is in the upright position and in the upward and downward directions when the handle is in a horizontal position. The cross section of the handle 12 may vary and may, for example, be circular or square. The shape may also be other than U-shaped; for example, it may be rounded or J-shaped if connected on only one side.

The handle 12 has gripping section 92, linking sections 94 and rounded corners 96. The gripping section 92 is at right angles to and connects the linking sections 94 through the rounded corners 96. The handle 12 is generally the same width as the lip 70. However, the ends of the linking sections 94, which are away from the gripping section 92, taper to narrower sections 98 which are narrower in width than the lip 70. As shown in FIG. 9, in this embodiment, the narrow sections 98 have clamping ends 100. The clamping ends 100 of the present embodiment are C-shaped each having an opening 101 and sized to snap fit around the posts 90. The handle 12, when fit to the posts 90, is rotatable about the post 90. The positioning of the opening 101 of the present embodiment allows for ease of assembly. In particular, for assembly, the handle 12 can be positioned in a rearward substantially horizontal position with the gripping section 92 resting on the lip 70 of the container 10 adjacent the rear wall 18. The openings 101 in the clamping ends 100 are aligned with the post 90 such that a downward force on the clamping ends 100 will allow the clamping ends 100 to snap into position over the posts 90.

The positioning of the openings 101 in the present embodiment also facilitates retention of the handle 12 on the container 10. In particular, when the handle 12 is in the rearward position, and the opening 101 is facing downward, the handle is not subject to an upward force. When the handle 12 is in the upward position, a portion of the clamping ends 100 are below the posts 90 to resist the posts 90 being pulled out of the clamping ends 100 by an upward force. When the handle 12 is in the forward position, again, a portion of the clamping ends 100 are below the posts 90 to resist the posts 90 being pulled out of the clamping ends 100 by an upward force.

In other embodiments, other means of rotatably or otherwise movably connecting the handle 12 to the container 10 may be used. For example, the handle 12 may be connected on only one side of the container 10. The handle 12 may also be replaced with another type of arm or member that is movable through other mechanisms such as ratcheting or through removal and reattachment in a different position.

The handle 12 of the present embodiment is rotatable to three different positions of use. In the first position, shown in FIGS. 1 to 4, the handle 12 is the rearward position. In the rearward position, the handle 12 is parallel to the base and rests on the lip 70. As can be seen in the cross-sectional cut out of the rear wall 18 in FIG. 2, the handle 12 has substantially the same width as the lip 70 and the rearward contact edges 97 of the handle 12 rest on the inside edge 78 and the outside edge 80 of the lip 70. As best see in FIG. 4, the handle 12 rests on the lip 70 all along the upper edge 31 of the rear wall 18 and along the portion of rear section top 48 of the side walls 20 which is to the rear of the extension 49. This gives a raised but uniform height to this section of the lip 70 as best seen in FIG. 2. However, in this position, the handle does not cross or in no way blocks the opening 15 of the container 10.

Figure 5:
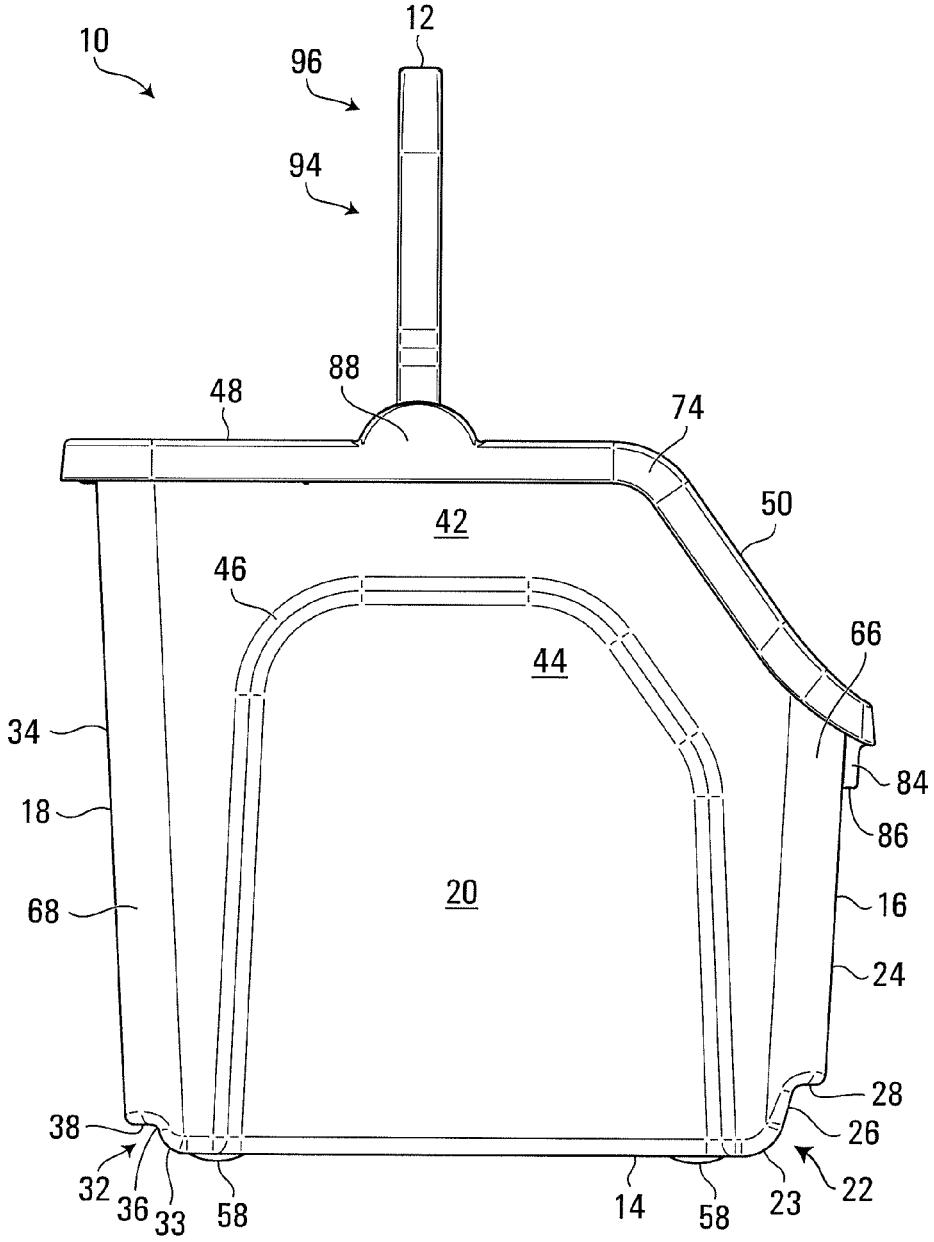
FIG. 5 is a side view of the stackable container of FIG. 1 with the handle in an upright position.
Figure 6:
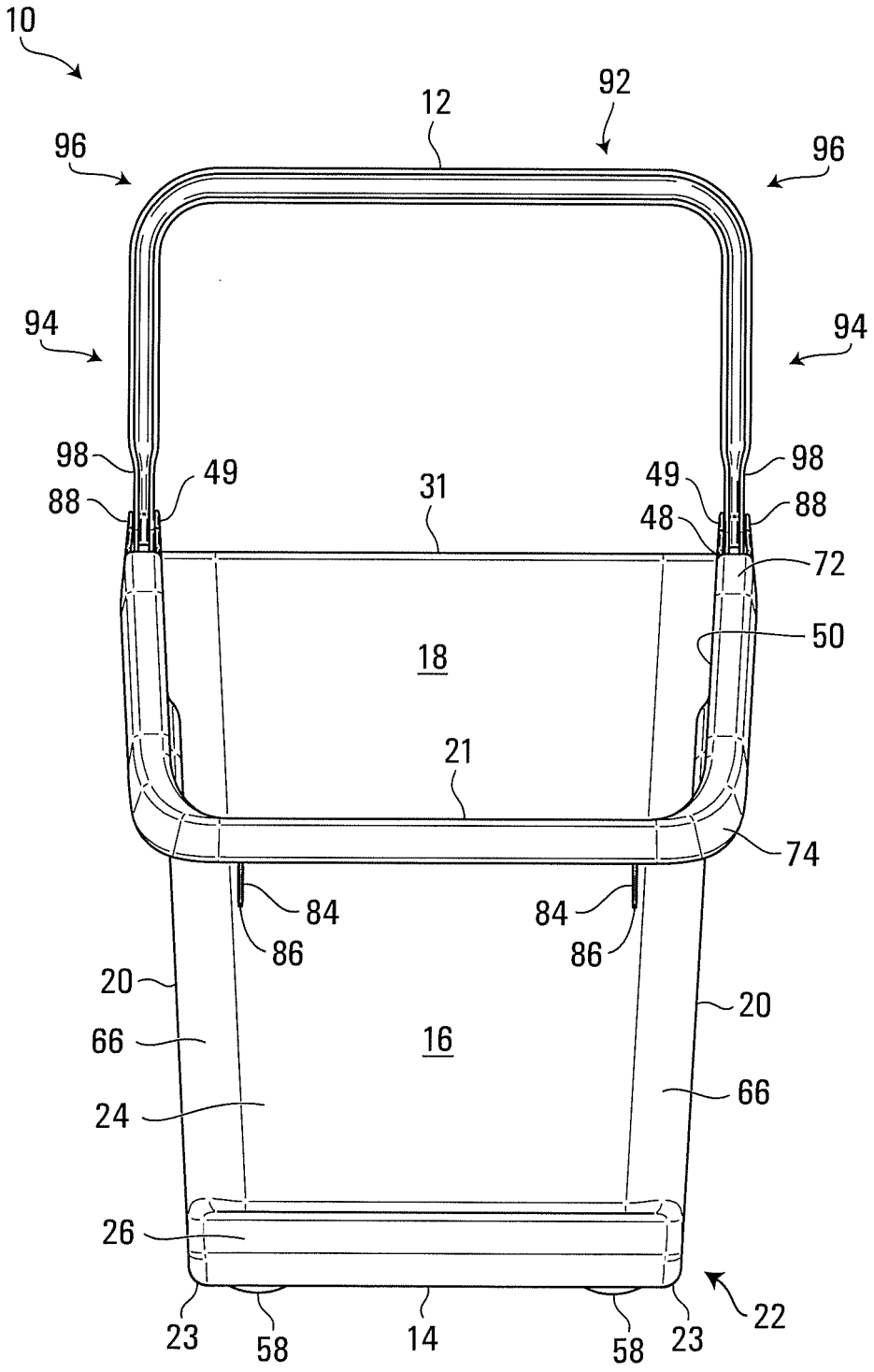
FIG. 6 is a front view of the stackable container of FIG. 5.

In the second position, shown in FIGS. 5 and 6, the handle 12 is in the upright position. In this position, the linking sections 94 of the handle 12 are perpendicular to the base 14 and the gripping section 92 is parallel to the base 14 and above the opening 15 of the container 12. As best see in FIG. 6, the handle 12 contacts the container 10 only by the C-clamp 100 connected to the post 90 between the extensions 49 and 88. In this position, the handle 12 curves upward over the opening 15 of the container 10.

Figure 7:
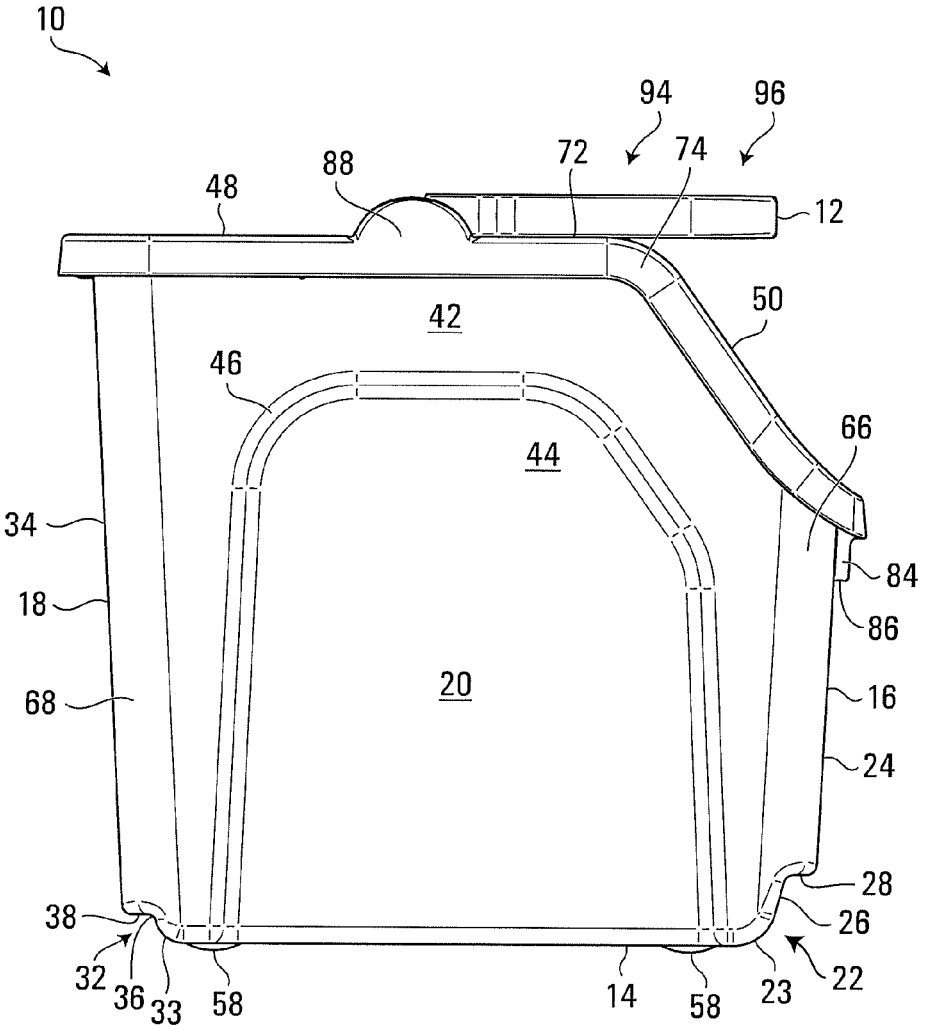
FIG. 7 is a side view of the stackable container of FIG. 1 with the handle in a forward position.
Figure 8:
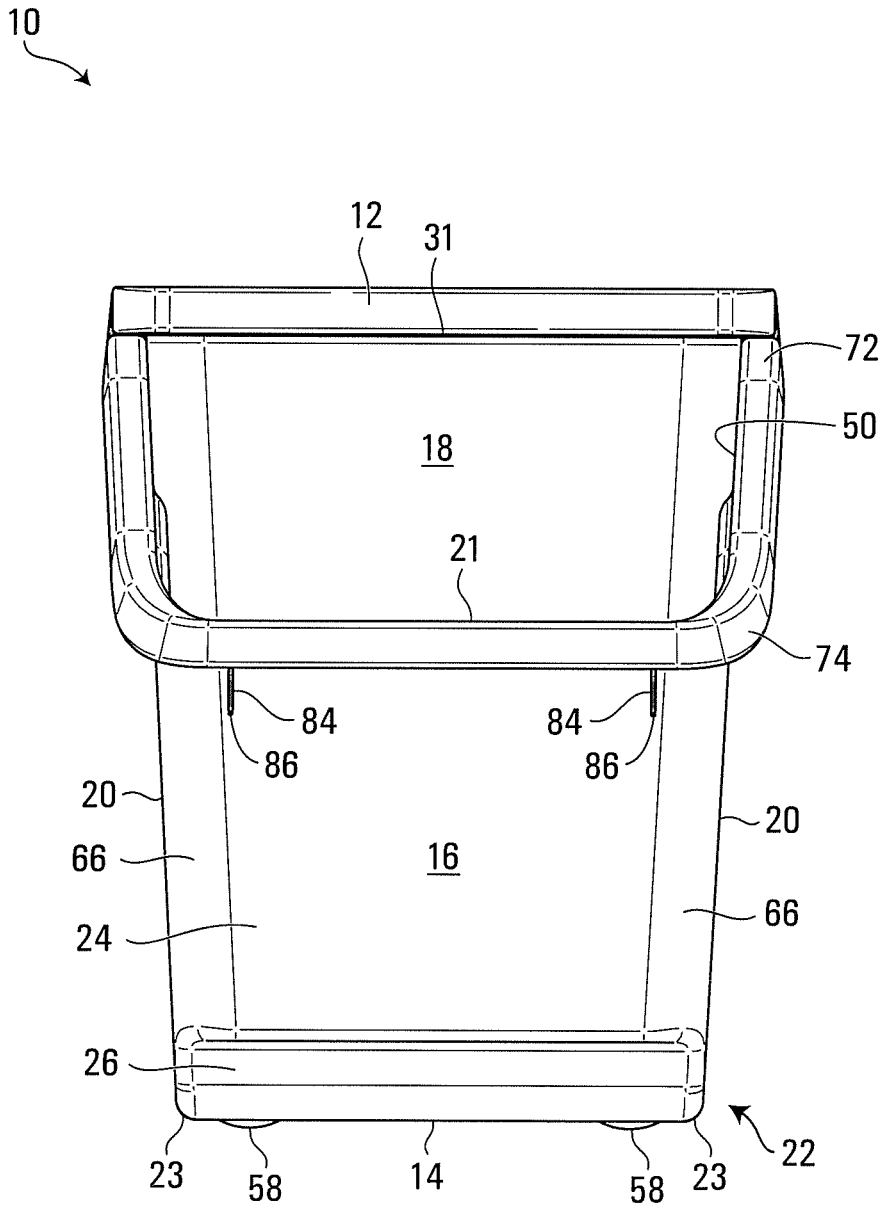
FIG. 8 is a front view of the stackable container of FIG. 7.

In the third position, shown in FIGS. 7 and 8, the handle 12 is the forward position. In the forward position, the handle 12 is parallel to the base and rests on a portion of the lip 70. As best see in FIG. 7, the handle 12 rests on the lip 70 all along the portion of the rear section top 48 of the side walls 20 which is in front of the extensions 49. This gives a raised but uniform height to this section of the lip 70. In this position, the handle 12 overhangs a portion of the opening 15.

Figure 10:
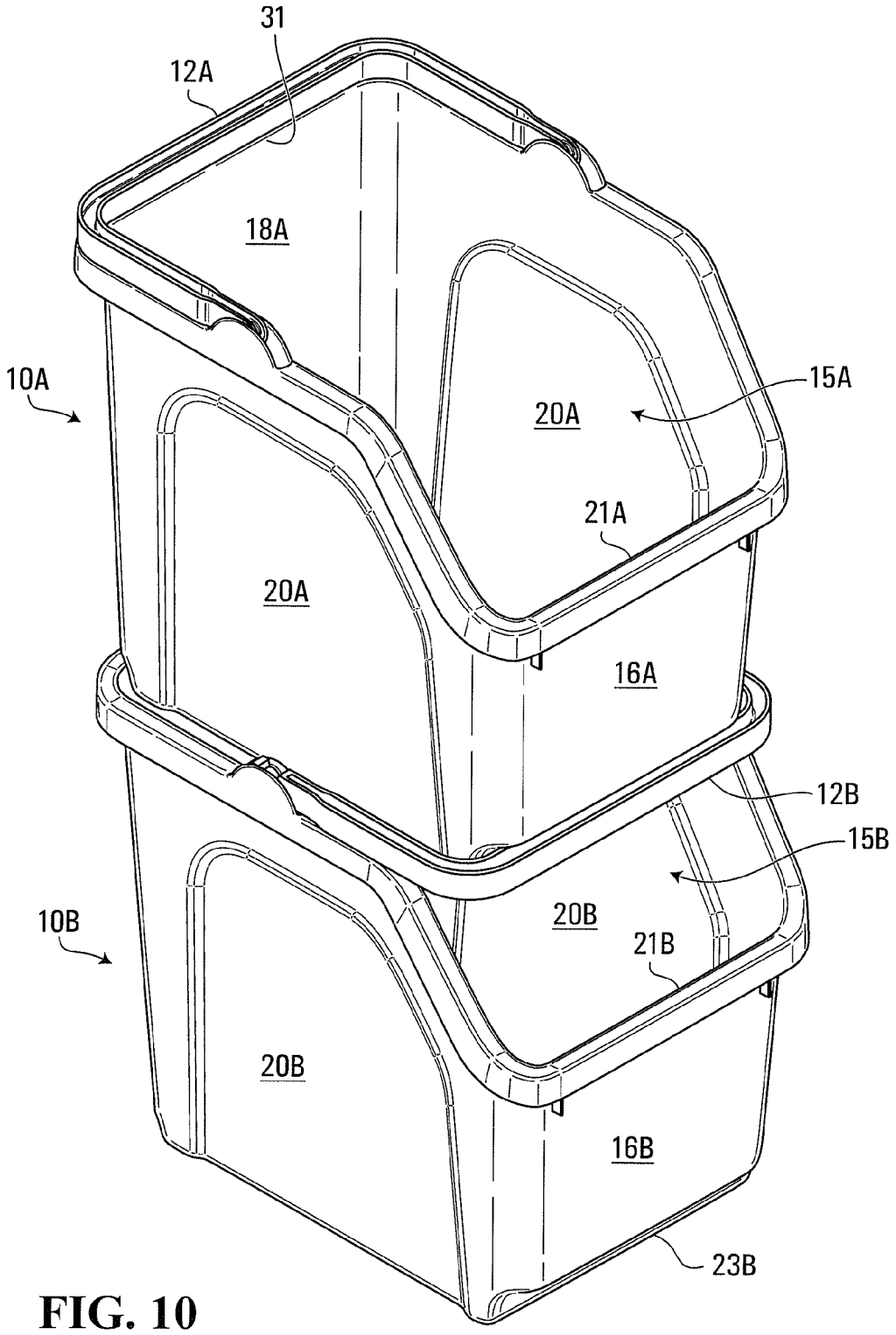
FIG. 10 is a perspective view of two of the stackable containers of FIG. 1 stacked in a supported position.
Figure 11:
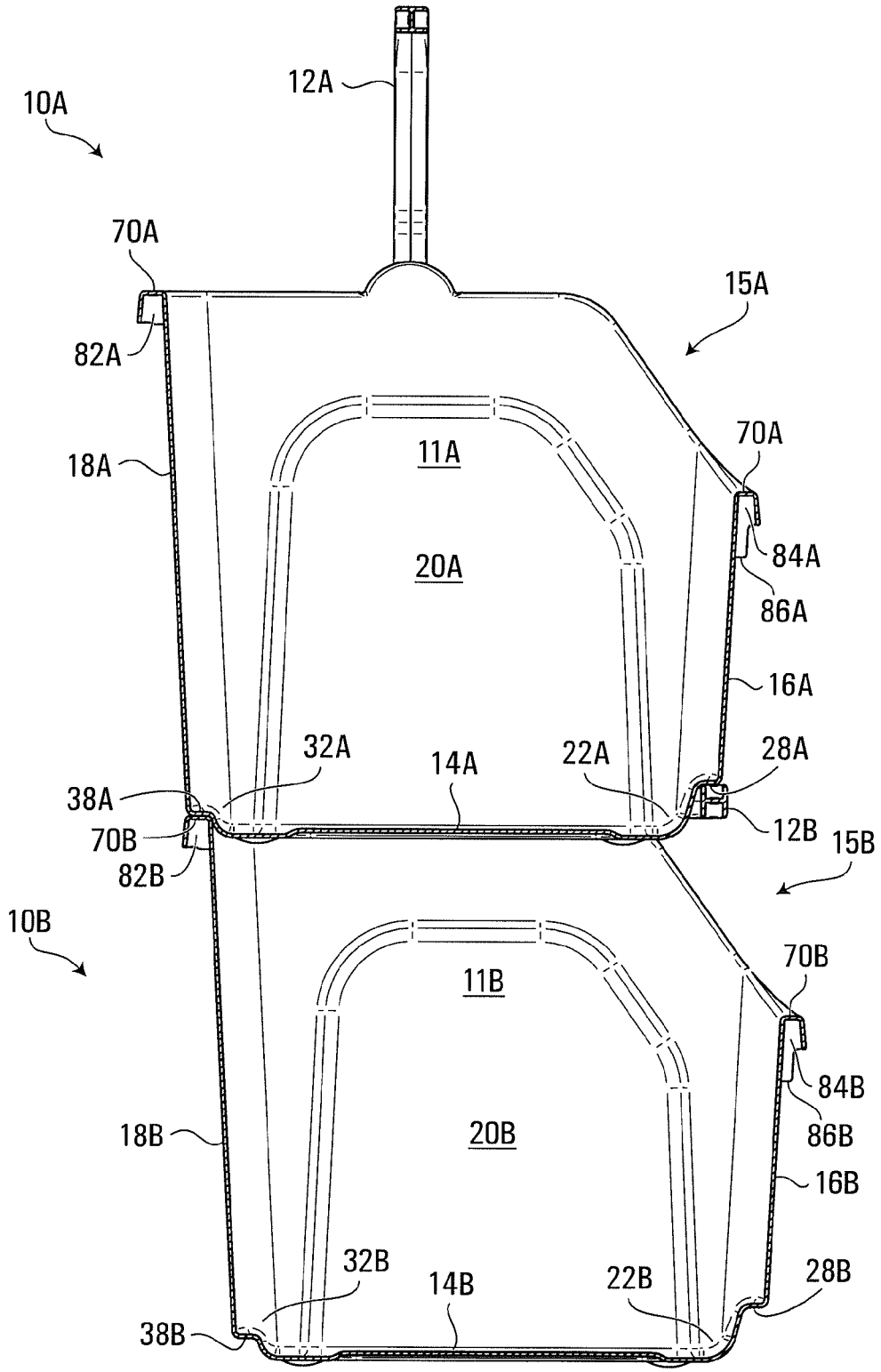
FIG. 11 is a cross-sectional view of the containers of FIG. 10.
Figure 12:
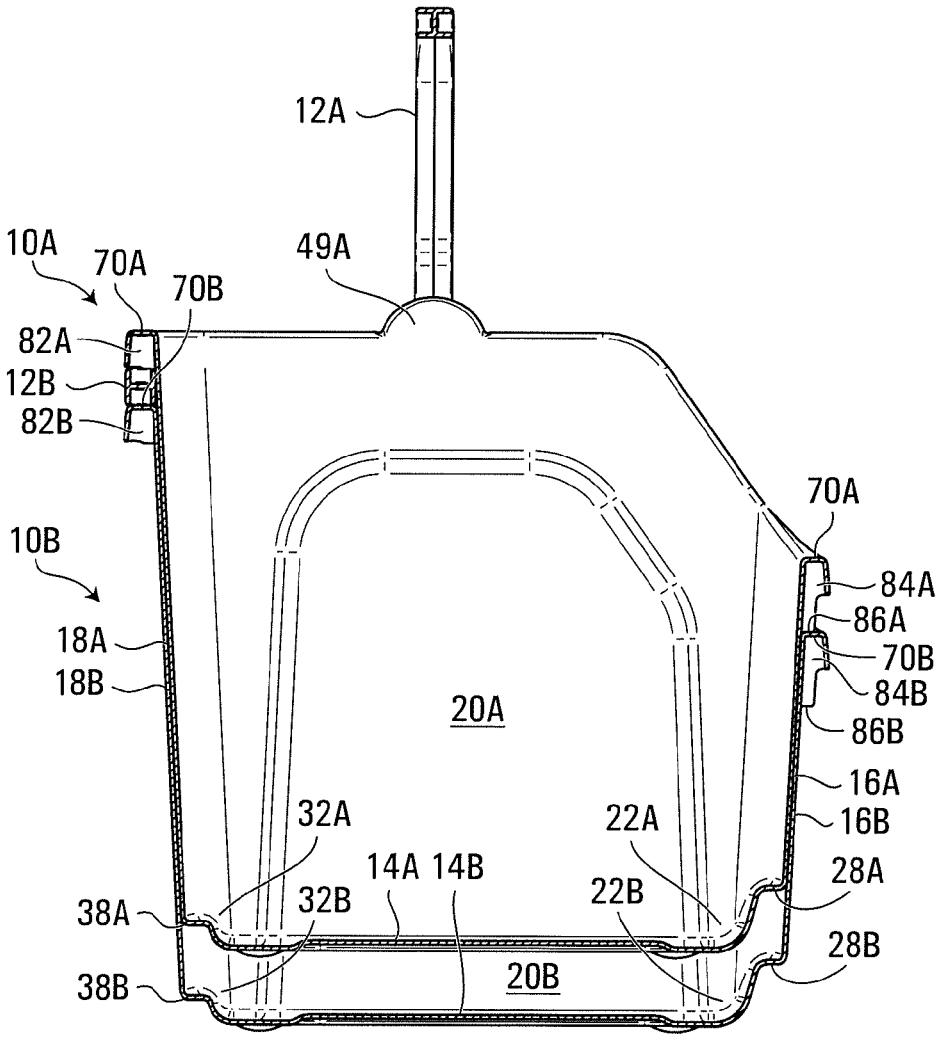
FIG. 12 is a cross-sectional view of two of the stackable containers of FIG. 1 stacked in a nested position.

FIGS. 10 to 12 depict how two containers according to the invention can be stacked one on top of the other. In FIGS. 10 to 12, the same reference numbers are used as in FIGS. 1 to 9 but an "A" has been added to denote parts of the upper container and a "B" has been added to denote parts of the lower container to facilitate the following explanation.

In FIGS. 10 to 12, the positioning of the handle 12B of the lower container 10B determines the position of the upper container 10A.

In FIGS. 10 and 11, the handle 12B of the lower container 10B is in the forward position. The upper container 10A is placed on top of the lower container 10B. In this position, the support ledge 38A of the rear wall 18A of the upper container 10A rests on the ledge 72B of the lip 70B of the lower container 10B. The support ledge 28A of the front wall 16A of the upper container 10A rests on the handle 12B of the lower container 10B. The container 10A is supported above the container 10B with a portion of the opening 15B of the lower container 10B accessible such that materials can be placed in both the upper container 10A and the lower container 10B in this position. The upper container 10A is supported above the lower container 10B by the ledges 28A resting on the lower handle 12B and the ledge 38A resting on the lower container 10B.

A review of FIG. 11 shows why the ledge 28A is further from the base 14A than the ledge 38A. In particular, the ledge 28A is further from the base 14A by the width of the handle 12B. This keeps the upper container 10A level in this position since the edges 97A of the handle 12A on which the ledge 28A of the container 10A rests are higher by the width of the handle 12B than the portion of the ledge 72B of the lip 70B on which the ledge 38A of the upper container 10A rests.

It can also be noted that the containers 10A and 10B are not precisely vertically aligned since the rear wall 18A of the upper container 10A is offset rearwardly from the rear wall 18B of the lower container 18B. This offset allows a greater portion of the opening 15B to be accessible than would be accessible if the containers 10A and 10B were precisely vertically aligned.

In FIG. 12, the handle 12B of the lower container 10B is in the rearward position. The opening 15B of the container 10B is completely unobstructed and open such that the upper container 10A can be nested into the lower container 10B. In this position, lip 70A of the rear wall 18A of the upper container 10A and the portion of the side walls 20A to the rear of the extension 49A, rests on the handle 12B of the lower container 10B. The lower faces 86A of the ribs 84A of the front wall 16A rest on the lip 70B of the front wall 16B of the lower container 16B. The container 10A is nested into the container 10B with walls 16A, 18A and 20A in contact with the walls 16B, 18B and 20B respectively such that the opening 15B of the lower container 10B is inaccessible. Materials can be placed in the upper container 10A but not in the lower container 10B in this position.

A review of FIG. 12 shows why the ribs 86A extend below the skirt 74A of the lip 70A. In particular, the ribs 86A extend below the skirt 74A by the width of the handle 12B. This keeps the upper container 10A level in this position since the edges 99A of the handle 12B on which the container 10A rests are higher by the width of the handle 12B than the portion of the lip 70B on which the ribs 86A rest.

It will be appreciated that the nested configuration of FIG. 12 is more compact and may be useful for storage.

Although FIGS. 10 to 12 show only two containers 10A and 10B, it will be appreciated that more containers may be stacked in either configuration or a combination of both.

The container 10 of the present embodiment may sit on the feet 58 or may be hung. For example, the container 10 may be hung from a wall by the lip 70.

The body of the container 10 may be moulded as a single plastic component in a variety of colors to identify what is intended to be placed in the container 10. The container may also have additional openings, may have multiple parts and may have, for example, a mesh structure.

It will be appreciated that the container 10 of the present embodiment can be changed from the nested position to the supporting position with the movement of a single member, namely the handle 12. The handle 12 may be replaced with other single members that can be changed in position to move between the nested and support position. For example, an arm may be swung into and out of position. This may result in easier stackability.

The embodiment disclosed herein is free of buttressing, vertical indents and ribs. Such a configuration may allow for greater area for hot stamping. It also can allow for a higher capacity, less material usage, a weight reduction, fewer areas in the interior where material can become trapped, and fewer sharp edges.

The stackable container of the present invention may be used as a recycling bin.

In this embodiment the container 10 is symmetrical about a vertical plane, front to rear, through the center of container 10. In other embodiments, the container 10 may not be symmetrical. For example, the handle 12 may connected to only one side of the container 10 or may be connected at the rear.

The designation of front, rear, top, bottom upward and downward in this description is for ease of reference and is not intended to be limiting.

What has been described is merely illustrative of the application of the principles of the invention. Other arrangements and methods can be implemented by those skilled in the art without departing from the spirit and scope of the present invention.

The invention claimed is:

1. A stackable container adapted to be stacked as an upper container or as a lower container with a second substantially identical container in two positions, the stackable container comprising:

a container body; and an arm movably connected to the container body;

the container body comprising a base and four walls, each of the four walls extending upwardly from the base to a height comparable to a width of the base to define an interior space, one of the four walls being shorter in height than another of the four walls;

the walls defining an opening;

wherein the arm is movable between (i) a first position in which the arm of the stackable container and an upper ledge of the stackable container, when the stackable container is the lower container, provide a support for the upper container wherein, when stacked, the upper container is supported above the stackable container with at least part of an interior of the stackable container accessible;

(ii) a second position in which, when the stackable container is the lower container, the arm is positioned to allow the upper container to nest within the stackable container with the interior space of the stackable container inaccessible; and (iii) a third position for carrying the stackable container, in which the arm is substantially centered over the opening.

2. The stackable container of claim 1 wherein the arm is rotatably connected to the stackable container.

3. The stackable container of claim 1 wherein the arm is a handle.

4. The stackable container of claim 2 wherein the stackable container and the arm are symmetrical and the arm is rotatably connected to the stackable container at two symmetrical points.

5. The stackable container of claim 1 wherein, in the second position, the arm does not cross the opening.

6. The stackable container of claim 1 wherein a first wall of the walls defines a first contour shaped to rest on the arm of the lower container when the stackable container is the upper container and the stackable container is stacked on the lower container in the first position.

7. The stackable container of claim 6 wherein the first contour comprises a lower portion of the first wall being inset from an upper portion of the first wall to define a ledge for resting on the arm of the lower container when the stackable container is the upper container.

8. The stackable container of claim 6 wherein a second wall of the walls defines a second contour shaped to rest on an upper end of a second wall of the lower container when the stackable container is the upper container and the stackable container is stacked on the lower container in the first position.

9. The stackable container of claim 8 wherein the upper end of the second wall of the stackable container defines a lip of the stackable container and the second contour of the stackable container rests on the lip of the lower container in the first position.

10. The stackable container of claim 8 wherein the second contour comprises a lower portion of the second wall being inset from an upper portion of the second wall to define a ledge for resting on the lower container.

11. The stackable container of claim 1 wherein the stackable container is offset forwardly from the upper container in the first position when the stackable container is the lower container.

12. The stackable container of claim 1 wherein the walls define a lip and the lip of the upper container rests on the lip of the lower container when stacked in the second position when the stackable container is the lower container.

13. The stackable container of claim 1 wherein the walls define an opening which is open on at least one side when the upper container is stacked on the lower container in the first position.

14. The stackable container of claim 13 wherein the opening is closed when the upper container is stacked on the lower container in the second position.

15. The stackable container of claim 2 wherein, the arm comprises at least one c-clamp and is rotatably connected to the stackable container by the at least one c-clamp, wherein the c-clamp is downwardly open in the second position.

16. The stackable container of claim 1 wherein at least three of the walls are substantially planar.

17. A stackable container adapted to be stacked as an upper container or as a lower container with a second substantially identical container in two positions, the stackable container comprising:

a container body; and a member movably connectable to the container body;

the container body comprising a base and four walls, each of the four walls extending upwardly from the base to a height comparable to a width of the base to define an interior space, one of the four walls being shorter in height than another of the four walls;

the walls defining an opening;

wherein movement of the member alone changes the stackable container from (i) a first position in which the member of the stackable container and an upper ledge of the stackable container, when the stackable container is the lower container, provide a support for the upper container wherein, when stacked, the upper container is supported above the stackable container with at least part of an interior of the stackable container accessible;

(ii) a second position in which, when the stackable container is the lower container, the member is positioned to allow the upper container to nest within the stackable container with the interior space of the stackable container inaccessible; and (iii) a third position for carrying the stackable container, in which the member is substantially centered over the opening.

18. The stackable container of claim 17 wherein the member is rotatably connected to the stackable container.

19. The stackable container of claim 1, wherein the opening is defined by the one of the four walls being shorter in height than other walls of the walls.

20. The stackable container of claim 17, wherein the opening is defined by a first wall of the walls being shorter in height than other walls of the walls.

21. The stackable container of claim 1, wherein the arm includes a gripping section and one or more linking sections.

22. The stackable container of claim 17, wherein the member includes a gripping section and one or more linking sections.

23. A stackable container adapted to be stacked as an upper container or as a lower container with a second substantially identical container in two positions, the stackable container comprising:

a container body; and only a single arm movably connected to the container body;

the container body comprising a base and four walls, each of the four walls extending upwardly from the base to a height comparable to a width of the base to define an interior space;

the walls defining an opening;

wherein the arm is movable between (i) a first position in which the arm of the stackable container and an upper ledge of the stackable container, when the stackable container is the lower container, provide a support for the upper container wherein, when stacked, the upper container is supported above the stackable container with at least part of an interior of the stackable container accessible;

(ii) a second position in which, when the stackable container is the lower container, the arm is positioned to allow the upper container to nest within the stackable container with the interior space of the stackable container inaccessible; and (iii) a third position for carrying the stackable container, in which the arm is substantially centered over the opening.

24. A stackable container adapted to be stacked as an upper container or as a lower container with a second substantially identical container in two positions, the stackable container comprising:

a container body; and an arm movably connected to the container body;

the container body comprising a base and walls extending upwardly from the base;

the walls defining an interior space and an opening;

wherein the arm is movable between (i) a first position in which the arm of the stackable container and an upper ledge of the stackable container, when the stackable container is the lower container, provide a support for the upper container wherein, when stacked, the upper container is supported above the stackable container with at least part of an interior of the stackable container accessible;

(ii) a second position in which, when the stackable container is the lower container, the arm is positioned to allow the upper container to nest within the stackable container with the interior space of the stackable container inaccessible; and (iii) a third position for carrying the stackable container, in which the arm is substantially centered over the opening; and wherein the stackable container has an upper lip on the wall that opposes the arm of the stackable container in the first position and the stackable container has a lower ledge such that, when stacked with the stackable container as the lower container, the upper lip of the lower container receives the lower ledge of the upper container to position the lower container offset forwardly from the upper container when the stackable container is in the first position.

25. A stackable container adapted to be stacked as an upper container or as a lower container with a second substantially identical container in two positions, the stackable container comprising:

a container body; and an arm movably connected to the container body;

the container body comprising a base and walls extending upwardly from the base;

the walls defining an interior space and an opening;

wherein the arm is movable between (i) a first position in which the arm of the stackable container and an upper ledge of the stackable container, when the stackable container is the lower container, provide a support for the upper container wherein, when stacked, the upper container is supported above the stackable container with at least part of an interior of the stackable container accessible;

(ii) a second position in which, when the stackable container is the lower container, the arm is positioned to allow the upper container to nest within the stackable container with the interior space of the stackable container inaccessible; and (iii) a third position for carrying the stackable container, in which the arm is substantially centered over the opening; and wherein, when the stackable container is the upper container, the stackable container is stackable on the lower container with the arm of the lower container in the first position with the stackable container extending below an upper surface of at least one of the walls of the lower container and below an upper surface of the arm of the lower container.

* * * * *